US008960491B2

(12) United States Patent
Logel et al.

(10) Patent No.: US 8,960,491 B2
(45) Date of Patent: Feb. 24, 2015

(54) CONTAINER

(75) Inventors: Valere Logel, Levallois-Perret (FR); Dominique Bois, Montreuil aux Lions (FR)

(73) Assignee: Clariant Production (France) S.A.S., Choisy le Roi (FR)

( * ) Notice: Subject to any disclaimer, the term of this patent is extended or adjusted under 35 U.S.C. 154(b) by 533 days.

(21) Appl. No.: 12/532,706

(22) PCT Filed: Mar. 26, 2008

(86) PCT No.: PCT/EP2008/053581

§ 371 (c)(1),
(2), (4) Date: Nov. 5, 2009

(87) PCT Pub. No.: WO2008/116888

PCT Pub. Date: Oct. 2, 2008

(65) Prior Publication Data

US 2010/0051636 A1 Mar. 4, 2010

(30) Foreign Application Priority Data

Mar. 26, 2007 (EP) ..... 07006145

(51) Int. Cl.
*B65D 43/16* (2006.01)

(52) U.S. Cl.
CPC ..... *B65D 43/169* (2013.01); *B65D 2251/20* (2013.01)
USPC ..... 220/840; 220/847; 220/810; 215/235; 222/556

(58) Field of Classification Search
CPC ..... B65D 43/169; B65D 2251/20
USPC ..... 220/375, 840, 847, 810; 215/306, 235, 215/237; 222/556
See application file for complete search history.

(56) References Cited

U.S. PATENT DOCUMENTS

| | | | | |
|---|---|---|---|---|
| 2,205,969 | A * | 6/1940 | Boenecke | 16/259 |
| 2,734,222 | A * | 2/1956 | Kiba | 220/840 |
| 2,990,077 | A | 6/1961 | VanBaarn | |
| 5,305,900 | A * | 4/1994 | Maguire et al. | 215/245 |
| 5,381,920 | A * | 1/1995 | Lin | 220/843 |
| 5,582,314 | A * | 12/1996 | Quinn et al. | 220/326 |
| 5,975,346 | A * | 11/1999 | Imperato et al. | 220/831 |
| 2005/0242105 | A1 * | 11/2005 | Homann | 220/840 |
| 2005/0247708 | A1 | 11/2005 | Golden | |
| 2007/0084735 | A1 | 4/2007 | Lancesseur et al. | |

FOREIGN PATENT DOCUMENTS

| | | | |
|---|---|---|---|
| DE | 29518905 | U1 | 1/1996 |
| EP | 0356322 | A1 | 2/1990 |
| EP | 1529731 | A1 | 5/2005 |
| FR | 2814348 | A1 | 3/2002 |
| JP | 3588464 | | 1/2005 |
| JP | 2005041575 | A | 2/2005 |
| WO | W02004031046 | A2 | 4/2004 |

* cited by examiner

*Primary Examiner* — Fenn Mathew
*Assistant Examiner* — James N Smalley
(74) *Attorney, Agent, or Firm* — Scott R. Cox

(57) ABSTRACT

The invention relates to a container (100) for loosely stored products, comprising a container body (10) having a connecting means (16), the container further comprising a cover (11) having a connecting means (19), said connecting means (19) of the cover (11) having a hinge (21), wherein said connecting means (19) of the cover (11) is engaged with said connecting means (16) of the container body (10) from below.

13 Claims, 5 Drawing Sheets

100

CONTAINER

1. TECHNICAL FIELD

Figure 1:
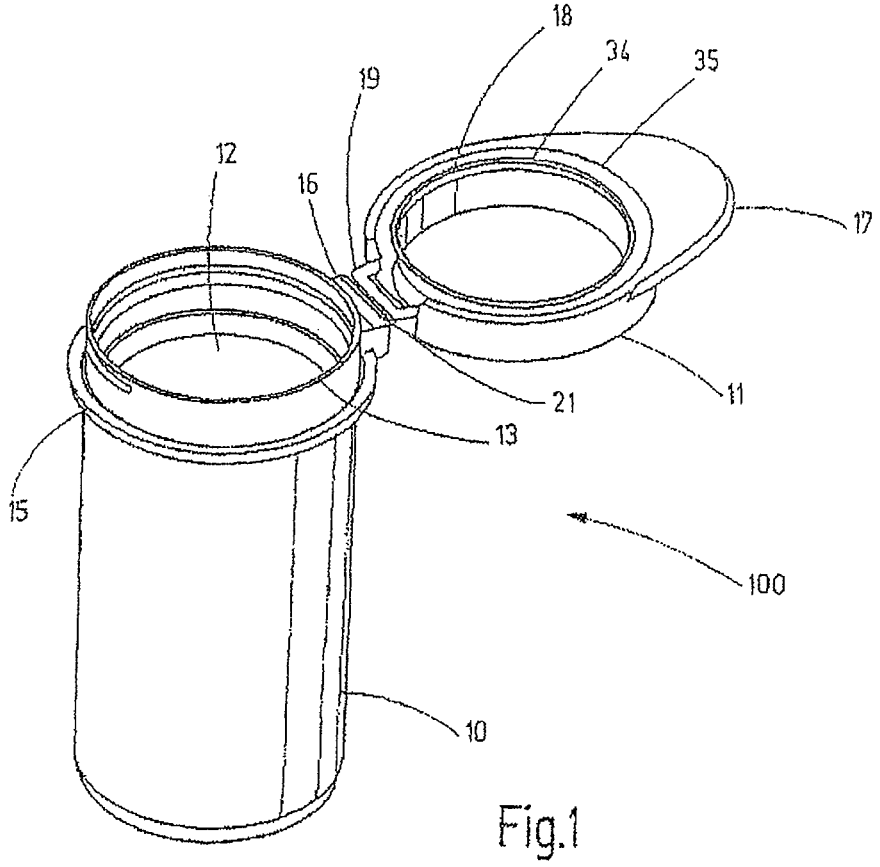

The present invention relates to a container for receiving loosely stored products, such as drugs, pills, tablets, granulate strips and even powder which has a container body and a cover, whereby a hinge is arranged between the container body and the cover, according to the preamble of claim 1.

2. PRIOR ART

Containers of the above mentioned type are known and common to the skilled in the art.

Containers of the above mentioned type can comprise a cap that is integrally attached to the container, wherein the cap has a circular base with an outer periphery and a cylindrical tubular skirt extending perpendicularly and outwardly around the outer periphery of the base. Furthermore such containers have also an upper portion and an inner and outer surface, wherein the container comprises a cylindrical upstanding rim at the upper portion, the rim being defined as the portion of the container that contacts an inner wall of the skirt of the cap, the rim having an inner and outer wall rim.

Further, such containers usually comprise a thumb tab for facilitating the opening and closing of the container and at least one hinge attached to the container wherein the hinge typically comprises at least one hinge recess bend point that functions to rotate the cap around a pivot point. The thumb tab and the hinge are typically positioned on substantially opposing ends of the cap and extend perpendicularly and outwardly from the skirt of the cap. A flexible lip is often part of such containers, whereby the flexible lip is a projection that projects concentrically from an interior surface of the base of the cap and, when the skirt of the cap overlies the container and at least a portion of the rim of the container engages the inner wall of the skirt of the cap, the flexible lip interacts with the rim to sufficiently deflect so as to form a re-sealable seal between the cap and the container.

However, due to its construction, these containers according to the prior art do not always fulfil the specifications which are often desired, e.g. with respect to the material of the container body and/or from the cover. Accordingly, it has often proved necessary using different materials for the cover and the container body. From the point of view of the manufacturers of such containers, it is often desirable providing the cover and the container body with different colours. In particular with respect to the material used, it should be noted that different specifications are often required from the material of the container body than from the material of the cover. Due to the fact that the container known from the prior art has a monoblock foil hinge, it is not possible to separate the container body and the cover.

WO 2004/031046 A2 discloses a container which has a hinge connection arranged in a connecting means for providing a hinge for a cap of said container. However, said hinge connection has a length of about 2 mm such that an exact hinge axis is not provided, but rather a hinge area, resulting in no exact definition of the rotation axis. Furthermore, a spring force acting on said hinge tends to open said cap, thus leaving a small gap even in the closed state of said cap.

3. SUMMARY

Starting from the disadvantages mentioned above, as well as under consideration of the prior art mentioned above, the objective of the present invention is to provide a container with an improved sealing performance.

This object is achieved by a container with the features of claim 1. Advantageous improvements can be ascertained from the dependent claims.

Accordingly, the container comprises a container body having a connecting means. The container comprising further a cover having a connecting means, said connecting means of the cover having a hinge, wherein said connecting means of the cover is engaged with said connecting means of the container body from below.

In this disclosure, the term "from below" is to be understood in the sense that the engagement is carried out in a direction substantially along the longitudinal axis of the container body and in a direction from the base of the container body towards its opening. Thus, the engagement movement is carried out in the same direction as a typical opening movement for removing a cap from a container.

By providing the engagement from below, the forces acting when closing the cover and the forces acting on the closed cover will always act into the engagement direction, resulting in a secure and tight engagement of the cover and the container body and a high cover attachment force. In particular, when closing the cover, e.g. the forces produced by the compression of a sealing arrangement between the cover and the container body, or the forces produced by a catch mechanism when pressing down on a thumb tab are received by the hinge and transformed into the engagement direction. In other words, the forces, in particular the elastic forces, acting on the hinge during closing always act into the engagement direction.

Furthermore, by providing a hinge between the container body and the cover there is a detachable connection between the container body and the cover with the consequence that the cover and container body can be easily recycled separately.

A further advantage can be seen in the fact that the connection between the container body and the cover can be configured so as to save space. This is in particular the case with respect to the necessary molding tools which can be provided in a reduced format and with reduced complexity.

The hinge arrangement provides for a clearly defined pivot axis for pivoting the cover. Advantageously, the connecting means have a snap in connection which both gives an exact place of mounting and easy replacement and assignment of the cover, compared to one-piece-arrangements.

Advantageously, the cover has an annular groove consisting of an inner and an outer wall, whereby the inner wall is situated inside the cover and is provided with a gasket.

In a further advantageous development, the container body has an opening which is surrounded by a flange or an edge, and preferably a bead which surrounds the container body and is provided with the connecting means extends outwardly of the flange or the edge.

According to a further advantageous development, the cover has an annular groove which is arranged inside the cover.

According to a further advantageous development, the connecting means is fixedly connected with the cover and has a triangular part which is connected with an engaging part by the hinge, which engaging part preferably has a recess.

According to a further advantageous development, the connecting means has an opening which extends between the side parts as well as with the edge or the flange as well as the web, preferably with an opening.

According to a further advantageous development, a gasket extends from an inner wall which depends from the cover when said cover is in a closed state and that said container is moisture-tight if the cover is in the close state, which gasket protrudes preferably outwardly from a wall extending from said cover.

According to a further advantageous development, the cover is produced independently and separately from said container body.

According to a further preferred embodiment, the connecting means are welded together by means of a welding connection. The welding connection is provided between an engaging part of the connecting means of the cover and a web which is provided as part of the connecting means of the body.

Preferably, this engaging part at least partially surrounds the web such that a safe mounting and securing is possible, and the welding connection additionally serves to avoid a detachment of the connecting means from each other.

4. BRIEF DESCRIPTION OF THE DRAWINGS

Further advantages, details and characteristics can be derived from the following description of embodiments of the invention by means of the exemplary drawings. The invention will be explained below in more details with reference to the Figures.

Figure 2A:
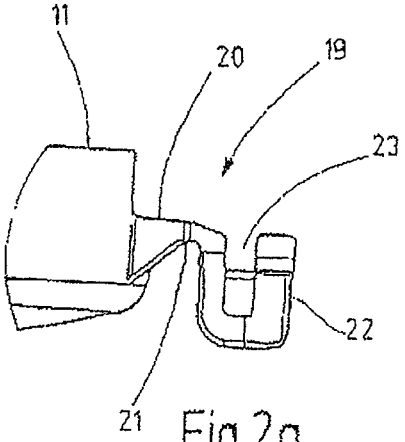
Figure 2B:
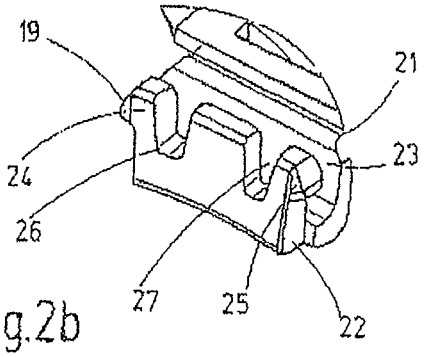
Figure 3A:
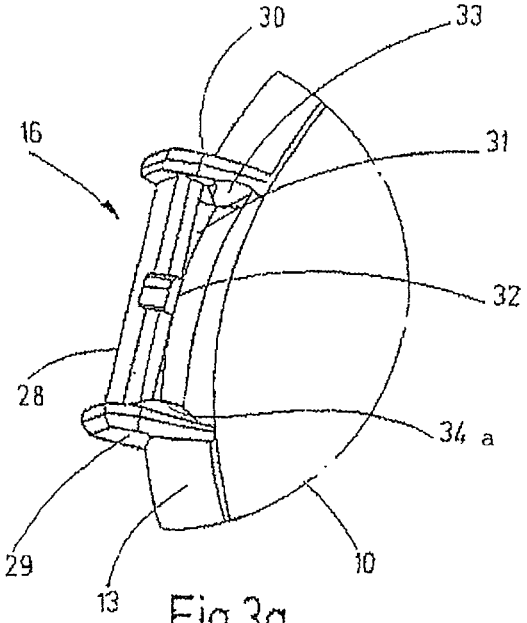
Figure 3B:
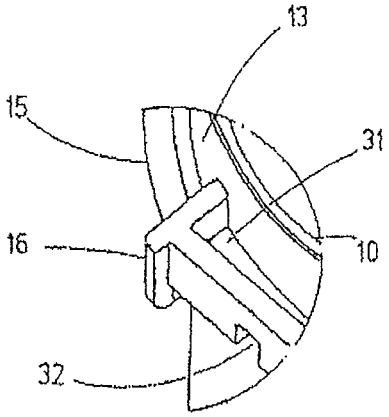
Figure 3C:
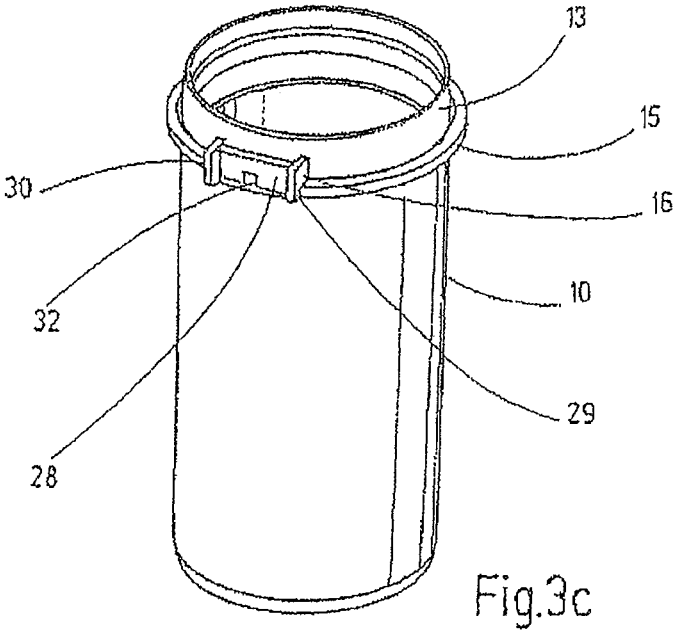
Figure 4:
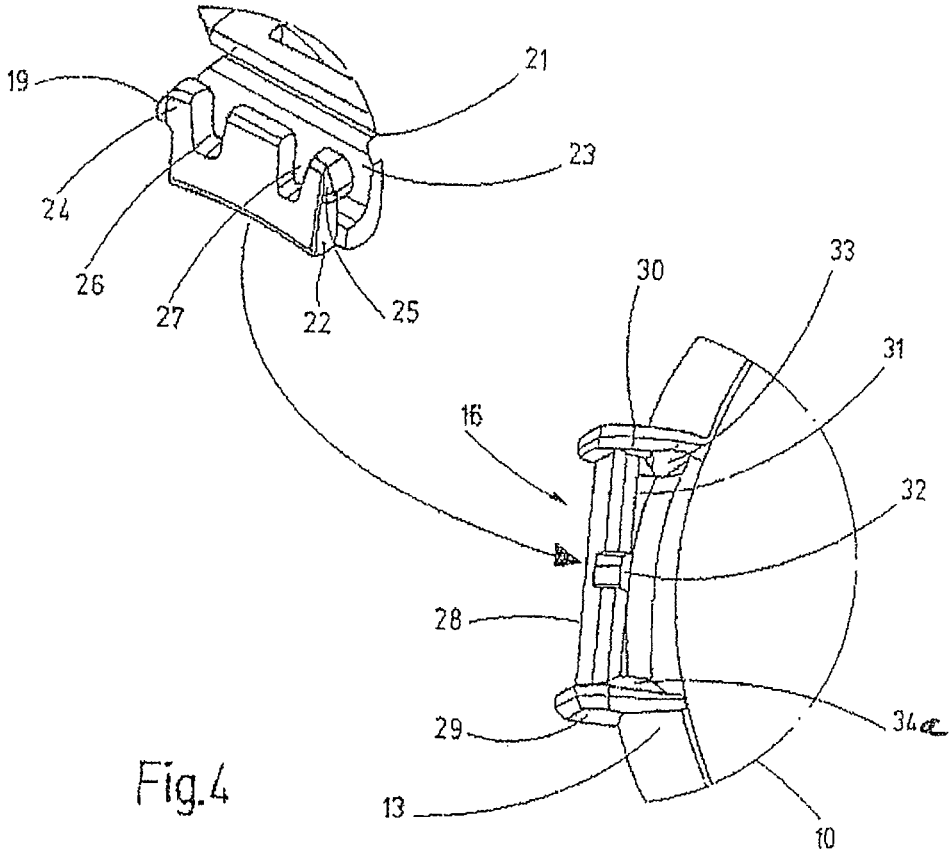

In the Drawings:

FIG. 1 is a schematic representation of a container consisting of the container body and the cover as well as the connecting means between the cover and the container body according to a first embodiment;

FIGS. 2*a* and 2*b* are schematic side and perspective views of the connecting means of the cover according to FIG. 1;

FIGS. 3*a* to 3*c* are schematic perspective views of the connecting means of the container body according to FIG. 1;

FIG. 4 are schematic perspective views of the connecting means of the cover which is to be guided through the opening of the connecting means of the container body;

FIGS. 5*a* to 5*f* are schematic side and perspective views showing different details of a container according to another embodiment; and FIGS. 6*a* to 6*f* are schematic side and perspective views showing different details of yet another embodiment.

5. DETAILED DESCRIPTION OF PREFERRED EMBODIMENTS

A container according to the invention which is provided with the reference numeral 100 is represented in FIG. 1.

The container comprises a container body 10 and a cover 11. Moreover, the container body has an opening 12 which is surrounded by a flange or an edge 13. A bead 15 which surrounds the container body 10 and which is provided with a connecting means 16 extends outwards from the flange or the edge 13. The exact configuration of the connecting means 16 will be dealt with in detail with reference to the FIGS. 2 and 3. The container body 10 is connected with the cover 11 which has a surface 17 and an annular groove 18 which is situated inside the cover 11. The connection of the cover 11 with the container body 10 is provided by the connecting means 19 of the cover 11 in such a manner that the connecting means 16 of the container body 10 and the connecting means 19 of the cover 11 are coupled with each other such that the cover 11 can be set onto the container body 10 by flaps. Thus, the edge or the flange 13 is introduced positively and/or non-positively into the annular groove 18.

The connecting means 19 of the cover 11 can be seen in a side view in FIG. 2*a*. The connecting means 19 is fixedly connected with the cover 11 and has a triangular part 20 which is connected with an engaging part 22 by a resilient foil hinge 21. The engaging part 22 is configured in such a manner that it can be clipped together, or snapped in, with the connecting means 16 of the container body 10. For this purpose, the engaging part 22 has a recess 23 which also can be seen in FIG. 2*b*. The recess 23 is bridged by a reinforcement rib 230 which extends between the outer side (right hand side of FIG. 2*a*) and the inner side (left hand side in FIG. 2*a*) of the engaging part 22. The reinforcement rib 230 improves the strength of any engagement action as it lowers the flexibility of the sidewalls of the recess 23.

Moreover, FIG. 2*b* shows that the engaging part 22 is provided with two locking means in the form of two claws 24, 25 and with two notches 26, 27. The claws 24, 25 are deformable due to the notches 26, 27.

FIGS. 3*a* to 3*c* show the connecting means 16 of the container body 10. The connecting means 16 of the container body 10 comprises a web 28 which is placed between two side parts 29, 30. The connecting means 19 is fixedly connected in one piece, or integrally, with the container body 10. Moreover, the connecting means 16 has an opening 31 which extends between the side parts 29, 30 as well as the edge or the flange 13 and the web 28. Oblique running surfaces 33, 34*a* are situated on the side parts 29, 30. These running surfaces 33, 34*a* are of essential importance, as can be derived from FIG. 4, for the positive and/or non-positive connection between the connecting means 16, 19. The side parts 29, 30 as well as the running surfaces 33, 34*a* are used to ensure a centring of the hinge 21 within the container opening.

As it further becomes clear from the FIGS. 3*a* to 3*c*, the web 28 is additionally provided with an opening 32. The aim of opening 32 is to be matchable with the reinforcement rib 230 which is designed in the recess of the engaging part 22 of the connecting means 19 of the cover 11. The reinforcement rib 230 improves the hinge detachment force as it reduces the flexibility of the recess of the engaging part 22 of the connecting means 19. As the reinforcing rib 230 can be received by the opening 32, the lateral stability of the opened cover is improved.

As can be seen in FIG. 4, the connecting means 19 can be guided through the opening 31 of the connecting means 16. Due to the notches 26, 27, the locking means in the form of the claws 24, 25 can be deformed in such a manner that, after having been guided through the opening 31, they come into locking engagement with the surfaces 33, 34*a*. In this manner, the two connecting means 16, 19 can be clipped together, or snapped into one another, and enter a positive and/or non-positive connection. During the clipping-in operation, the connecting means 16 may be deformed. The connecting process is carried out from below.

As it can be derived from FIGS. 1 to 3, the container body 10 and the cover 11 can be detachably connected with each other. With respect to the connecting means 16, 19, the foil hinge 21 is an integrated constituent part of the cover 1, but is not integrally connected with the container body 10.

Moreover, the annular groove 18 has—as it can be derived from FIG. 1—an inner and an outer wall 34, 35. The inner wall 34 is situated inside the cover 11. It is further provided within the scope of the invention that the inner wall 34 is provided with a gasket. The gasket is thus annular too and extends inside the groove 18, i.e. along the inner wall 34.

FIGS. 5*a* to 5*f* show another embodiment of a container 100.

Figure 5A:
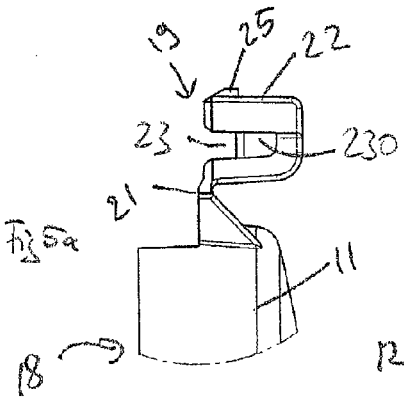

FIG. 5*a* is a schematic side view of the cover 11, the connecting means 19 and the hinge 21. Engaging part 22 of the connecting means 19 has, in the side view, a generally U-shaped cross-section. Inside the recess 23 which is formed by the U-shaped engaging part 22, a reinforcing rib 230 is provided. As the reinforcing rib 230 spans the two sides of the recess 23, it serves to reduce the flexibility of the engaging part 22 and, thus, to improve the engagement force. Annular groove 18, which is only schematically shown in this Figure, is open towards to same side as the U-shaped recess 23 of the engaging part 22. Accordingly, molding tools can be provided for in a relatively easy configuration as undercuts in the cover 11 are basically avoided.

A locking means in the form of a catch 25 is present on the outer side of the engaging part 22, said locking means 25 being formed such that it can be brought into locking engagement with the container body 10, as will be explained in the following.

Figure 5B:
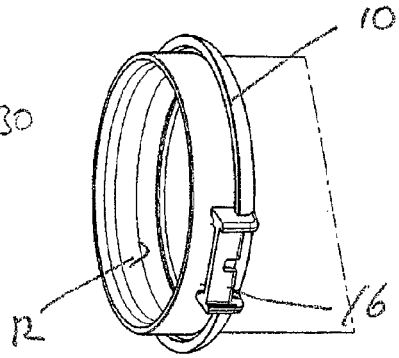
Figure 5C:
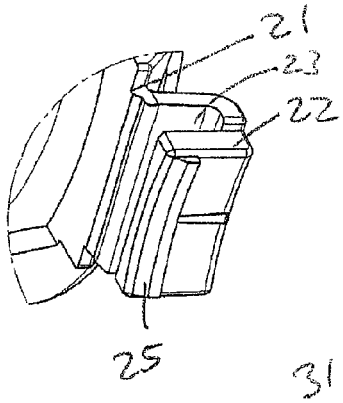

FIG. 5*c* shows the arrangement of FIG. 5*a* in a schematic perspective view. It becomes immediately apparent that the locking means in the form of catch 25 as well as the outer wall of the engaging part 22 are slightly bent, i.e. provided with a curved surface, the radius of which resembling the radius of the outer wall of the container body 10 as shown, e.g. in FIG. 5*b* or 5*d*.

Figure 5D:
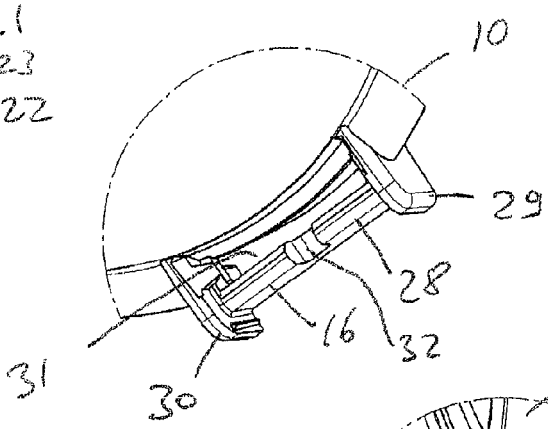

FIGS. 5*b* and 5*d* show schematic perspective details of the container body 10 and the connecting means 16. In particular, connecting means 16, as shown in FIG. 5*d*, comprises side parts 29 and 30 and a web 28 with an opening 32. A general opening 31 between the outer wall of the container body 10 and the web 28 is provided, through which general opening 31 the outer side of the engaging part 22 of the cover 11 can be slid from below. FIG. 5*d* shows the connecting means 19 from the lower side. Web 28 is chamfered in order to easily receive the recess of the engaging part 22. The reinforcement rib 230 in the recess 23 of the engaging part 22 can be received in the opening 32 of the web.

Figure 5F:
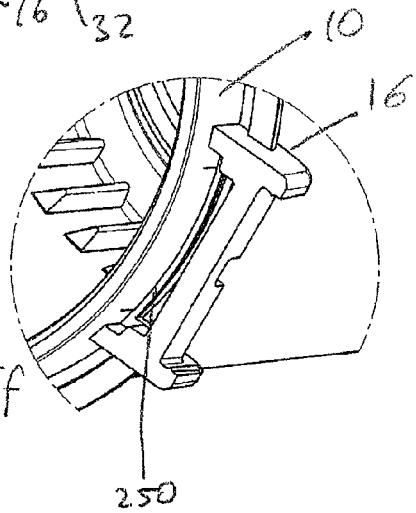

FIG. 5*f* shows the connecting means 19 in a view from the upper side. A shoulder 250 at the container body 10 is clearly visible, which provides the counter surface for the catch 25 of the engaging part 22 in order to provide for a locking engagement. Due to the slightly bent shape of the catch 25, it snugly abuts to the outer side of the container body 10, resulting in an improved lateral stability of the cover 11 in its opened situation. The improved lateral stability is mainly due to the "3-point" attachment of the catch 25 on the shoulder 250.

The engagement or connection process between the cover 11 and the container body 10 takes place by slipping the engaging part 22 of the connecting means 19 of the cover 11 onto the connecting means 16 of the container body 10 from below. In particular, during the engagement procedure, the connecting means 22 is slid, with its U-shaped recess 23, over web 28 in a direction along the general longitudinal axis of the container body 10 in a direction from the bottom of the container body 10 towards the opening 12 of the container body 10.

Figure 5E:
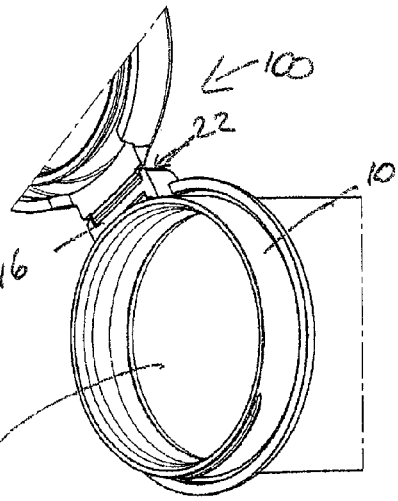

The resultant connection can be seen in FIG. 5*e*, in which the connecting means 22 is clipped onto the connecting means 16 of the container body 10, wherein, at the same time, the locking means in the form of catch 25 is in locking engagement with the shoulder 250 of the container body 10.

As a result, when closing cover 11 over the opening 12 of the container body 10, during the closing process a locking force is exhibited such that the engaging part 22, or rather the U-formed recess 23 of engaging part 22, is pressed along the engagement direction against web 28, resulting in a secure and tight fit of the cover 11 on the opening 12.

Due to the connection of the engaging part 22 of cover 11 to the connecting means 16 of the container body 10 from below, a improved sealing performance can be achieved.

Due to the non-integrated approach of container body 10 and cover 11, different materials can be used for the container body 10 and the cover 11, respectively, resulting in an easy-to-tailor container 100. These different materials can be easily recycled as they can be disassembled easily.

When closing the cover 11 onto the opening 12 of the container body 10, the pressing down of the cover 11 typically takes place at a thumb tab in an area opposite the hinge 21. Accordingly, a lever acts on the hinge 21 as the cover 11 is pressed down, resulting in a force that acts substantially along the longitudinal direction of the container body 10 in the direction from the bottom of the container body 10 towards the opening 12. The resultant forces acting onto the hinge 21, thus, act in the engagement direction of the engaging part 22 and the connecting means 16 of the container body 10, leading to a situation in which the engaging part 22 is pressed into even tighter engagement. This results in a secure and tight closing of the cover. Furthermore, the constant pull on the hinge 21 also leads to a exact positioning of the pivoting axis.

FIGS. 6*a* to 6*f* show yet another embodiment of a container 100.

Figure 6A:
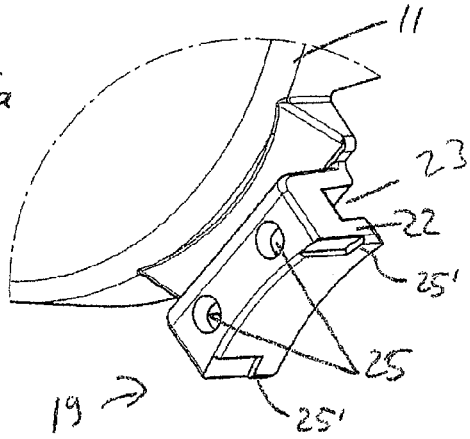
Figure 6B:
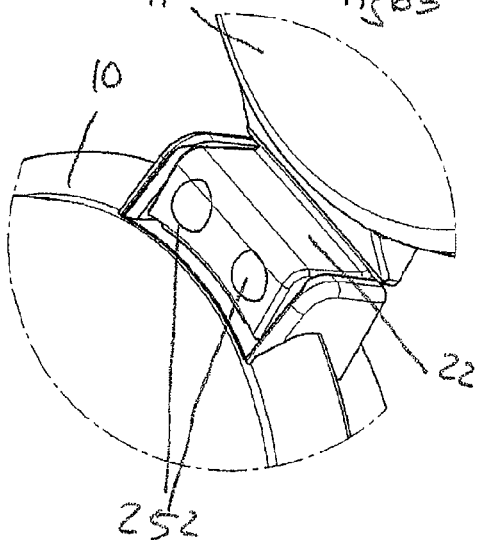
Figure 6C:
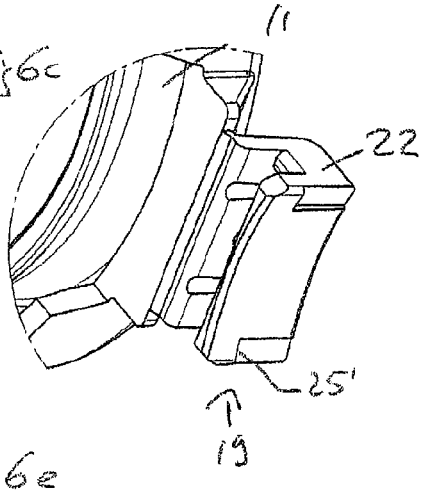

FIGS. 6*a* and 6*c* show the cover 11 and the respective connecting means 19 in perspective schematic views from the bottom side and from the top side. Engaging part 22 has, again, a recess 23 which is, in its cross section, U-shaped and which is made to receive a respective counter-part in the form of web 28 of the connecting means 16 of container body 10.

Figure 6D:
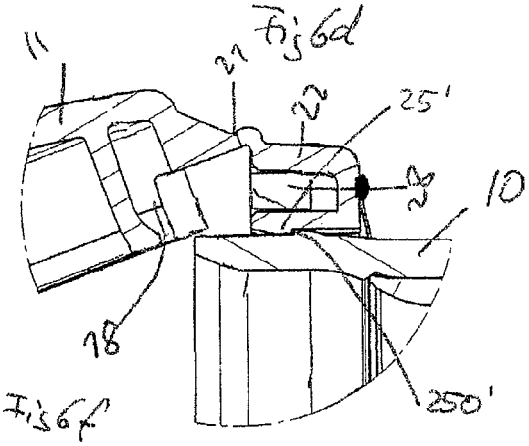
Figure 6E:
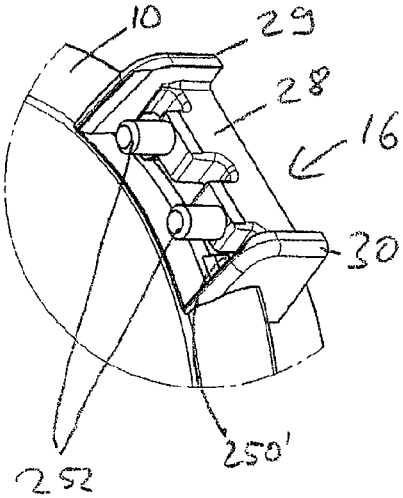
Figure 6F:
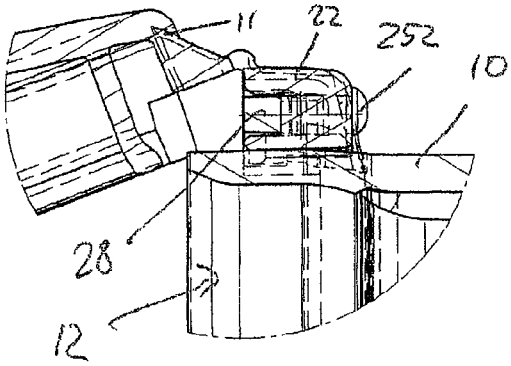

Locking means in the form of two through bores 25 are present which will be used, as will be shown in FIGS. 6*b*, 6*d* and 6*f*, for welding or riveting the cover 11 by means of riveting studs 252 to the container body 10. The through bores 25 are situated in the lower part of the U-shaped recess 220.

The outer wall of the engaging part 22 is, again, bent or curved with a radius that resembles that of the outer surface of the container body 10.

FIG. 6*e* shows a respective counter-part of the container body 10, namely the connecting means 16. Connecting means 16 comprises a web 28, two side parts 29, 30 and two riveting studs 252, which extend towards the bottom of the container body 10. The two studs 252 are made such that they can be received by the two through bores 25 of the engaging part 22 as it is shown in FIGS. 6*a* and 6*c*.

FIG. 6*b* shows the container body 10 and the cover 11 in the connected state. The two studs 252 are welded, or riveted, such that the engaging part 22 is securely locked into position.

FIG. 6*d* shows the cover 11 and the container body 10 in the locked position, in which the two studs 252 are riveted such that the engaging part 22 is securely locked to the container body 10.

The engaging part 22 is secured to the connecting means 16 from below.

In addition to the securement provided by the welding connection, two catches 25' and two respective shoulders 250' are provided, the catches 25' in the connecting means 19 of the cover 11 and the shoulders 250' in the connecting means 16 of the container body 10.

LIST OF REFERENCE NUMERALS

100 Container
10 Container body
11 Cover
12 Opening
13 Edge or flange
15 Bead
16 Connecting means
17 Surface

18 Groove
19 Connecting means
20 Triangular part
21 Foil hinge
22 Engaging part
23 Recess
230 Reinforcing rib
24 Locking means
25 Locking means
25' Locking means
250 Shoulder
250' Shoulder
26 Notch
27 Notch
28 Web
29 Side part
30 Side part
31 Opening
32 Opening
33 Oblique surface
34*a* Oblique surface
34 Inner wall

The invention claimed is:

1. Container for receiving loosely stored products such as drugs, pills, tablets, granulate strips or powder, comprising a cylindrical container body comprising a base at one end with an opening at an opposite end thereof and an outer wall of the container body with a radius, the container body further comprising a connecting means for connecting the container body with a cover, and wherein the container further comprises the cover also having a connecting means for connecting the cover with the container body, said connecting means for connecting the cover with the container body comprising a hinge, characterized in that said connecting means for connecting the cover with the container body is engaged with said connecting means for connecting the container body with the cover from below in a direction from the base to the container opening, and wherein the hinge comprises a resilient foil hinge, wherein a pivot axis of the foil hinge is located at or below the container opening.

2. Container according to claim 1, wherein said connecting means for connecting the cover with the container body is clipped and/or snapped into engagement with said connecting means for connecting the container body with the cover from below.

3. Container according to claim 1, wherein the connecting means for connecting the cover with the container body comprises an engaging part which comprises a recess for receiving the connecting means for connecting the container body with the cover, wherein the hinge is arranged between the engaging part and the cover.

4. Container accordingly to claim 3, wherein the engaging part extends at least partially around a web of the connecting means for connecting the container body with the cover.

5. Container according to claim 1, wherein the connecting means for connecting the cover with the container body and/or the connecting means for connecting the container body with the cover further comprise locking means for locking the cover to the container body.

6. Container according to claim 5, wherein the locking means consists of at least one claw, catch, shoulder, or welding stud, resulting in a snapping, clipping or welding connection of the cover to the container body.

7. Container according to claim 1, wherein the connecting means for connecting the container body with the cover comprise a snap-in element which comprises oblique surfaces arranged at side parts of the connecting means for connecting the container body with the cover, the oblique surfaces acting to center said connecting means for connecting the cover with the container body to said connecting means for connecting the container body with the cover.

8. Container according to claim 1, characterized in that said connecting means for connecting said container body with the cover extends outwardly of an edge of said container body and has a general opening which is formed between said edge and a web of said connecting means for connecting the container body with the cover which extends radially outwardly of said general opening.

9. Container according to claim 1, wherein the connecting means for connecting the container body with the cover is arranged in the vicinity of a bead of said container body, which bead extends outwardly from said container body and surrounds an upper end of said container body.

10. Container according to claim 9, wherein the connecting means for connecting the container body with the cover extends from or is supported by said bead.

11. The container according to claim 1, wherein the resilient foil hinge comprises a pivoting element secured to the cover enabling a pivoting movement of the cover relative to the container at the resilient foil hinge from a fully open position to a closed position.

12. The container of claim 1, wherein the hinge further comprises an engaging part with a generally U-shaped cross section containing a recess.

13. The container of claim 12, wherein the engaging part further comprises a reinforcement rib which spans the recess.

* * * * *